US006100002A

United States Patent [19]

Noguchi

[11] Patent Number: 6,100,002

[45] Date of Patent: Aug. 8, 2000

[54] METHOD FOR DEVELOPING AN ELECTROSTATIC LATENT IMAGE

[75] Inventor: Koji Noguchi, Saitama-ken, Japan

[73] Assignee: Hitachi Metals, Ltd., Tokyo, Japan

[21] Appl. No.: 08/347,190

[22] Filed: Nov. 21, 1994

Related U.S. Application Data

[63] Continuation of application No. 08/012,637, Feb. 3, 1993, abandoned.

[30] Foreign Application Priority Data

Feb. 7, 1992 [JP] Japan ..... 4-022434

[51] Int. Cl.[7] ..... G03G 15/09

[52] U.S. Cl. ..... 430/122; 430/125

[58] Field of Search ..... 430/110, 111, 430/125, 122

[56] References Cited

U.S. PATENT DOCUMENTS

| | | | |
|---|---|---|---|
| 4,626,487 | 12/1986 | Mitsuhashi et al. | 430/110 |
| 4,824,752 | 4/1989 | Yasuda et al. | 430/110 |
| 4,824,754 | 4/1989 | Mikami | 430/110 |
| 4,931,841 | 6/1990 | Yoshihara et al. | 430/58 |
| 5,219,694 | 6/1993 | Anno et al. | 430/110 |
| 5,395,717 | 3/1995 | Ozawa et al. | 430/122 |
| 5,406,357 | 4/1995 | Nakahara et al. | 430/110 |

FOREIGN PATENT DOCUMENTS

| | | |
|---|---|---|
| 416 750 | 3/1991 | European Pat. Off. . |
| 435 608 | 7/1991 | European Pat. Off. . |
| 435 610 | 7/1991 | European Pat. Off. . |
| 54-8430 | 7/1979 | Japan . |
| 56-110947 | 9/1981 | Japan . |
| 59-28165 | 2/1984 | Japan . |
| 63-195659 | 8/1988 | Japan . |

OTHER PUBLICATIONS

Diamond, Arthur S. (1991) *Handbook of Imaging Materials.* New York: Marcel–Dekker, Inc. pp. 183, 204, 225, 379–382.

*Primary Examiner*—Christopher D. Rodee
*Attorney, Agent, or Firm*—Finnegan, Henderson, Farabow, Garrett & Dunner

[57] ABSTRACT

A method of forming an image includes the steps of forming an electrostatic latent image on an organic photoconductive drum, applying a developer containing toner particles to a sleeve in which a permanent magnet member is disposed, developing the electrostatic latent image by relative rotation of the sleeve to the permanent magnet member such that a magnetic brush is formed on the sleeve, the magnetic brush brushing the surface of the photoconductive drum to form a toner image, transferring the toner image to a transfer means, fixing the transferred image, and cleaning the remaining toner particles from the image carrier with a fur brush. The developer contains toner particles comprising at least one binder resin and a colorant, and from 0.1 to 3 parts by weight per 100 parts by weight of the toner particles of finely powdered cleaning assistant is disposed on the surface of the toner particles. The toner particles have an average size of 2 to 9 $\mu$m and are produced by polymerization, and the cleaning assistant is at least one oxide of a rare earth element having an average particle size of 0.01 to 5.0 $\mu$m.

2 Claims, No Drawings

METHOD FOR DEVELOPING AN ELECTROSTATIC LATENT IMAGE

This application is a continuation of application Ser. No. 08/012,637 filed Feb. 3, 1993, now abandoned.

BACKGROUND OF THE INVENTION

The present invention relates to a toner for developing an electrostatic latent image which is used for developing an electrostatic latent image in electro-photography, electrostatic recording, etc. Particularly, it relates to a toner for developing an electrostatic latent image which is good in ease of cleaning, namely, which can easily be removed from the surface of an image carrier after transfer.

In conventional image-forming methods utilizing electrophotography or electrostatic recording, an electro-static latent image formed on the surface of an image carrier composed of a photoconductor, a dielectric or the like is developed into a toner image by brushing with a so-called magnetic brush composed of a developer, by the use of, for example, a developing means comprising a permanent magnet member built-in and a sleeve fitted thereto so that they can rotate freely in relation to each other. Then, the toner image is fixed directly or after its transfer to a transfer sheet such as ordinary paper, whereby a final image is obtained.

As a conventional process for producing a toner constituting the aforesaid developer, there is known a process of heating raw materials, followed by kneading, solidifying by cooling, grinding and then classification. For obtaining an image having a high solid density and little fog, the particle size distribution of the toner is usually adjusted so that the average particle size may be 9 to 13 $\mu$m. However, recently, there is a growing demand for improvement of the quality of image. For satisfying this demand, the toner tends to be reduced in particle size and should be formed so as to have an average particle size of 2 to 9 $\mu$m.

The toner with a small particle size produced by the above process involving grinding, however, is disadvantageous in that it has a low flowability because its particles are shapeless. When a large amount of a flowability improver such as finely powdered silica is added for improving the flowability, the flowability is improved but a problem is caused such as damage to the surface of a photosensitive layer, or a great change of the degree of tribo-electric charging which is attributable to moisture.

In order to solve the problems in the above process involving kneading and grinding, processes for producing a toner by suspension polymerization have been proposed (see, for example, Japanese Patent Unexamined Publication Nos. 54-84730, 56-110947 and 59-28165). In these processes comprising suspension polymerization, a monomer composition prepared by dissolving or dispersing a polymerizable monomer, a colorant, and optionally a polymerization initiator, a crosslinking agent, a charge-controlling agent and other additives is added to a dispersion medium containing a suspension stabilizer with stirring to be granulated, followed by polymerization, whereby a toner is formed.

Since the above processes comprising suspension polymerization do not involves a grinding step at all, the product need not be brittle or fragile, and the colorant and the like do not appear at the rupture cross-section of the toner formed by grinding. Therefore, these processes are preferable production processes. Moreover, they are considered advantageous, for example, in that particles of the toner obtained has a spherical shape and hence are excellent in flowability.

As a method for forming an image by the use of a two component magnetic developer containing a toner such as is described above, a method comprising development, transfer, fixing and then fur brush cleaning has been made practicable. For obtaining a highly precise image, employment of a toner with a small particle size, such as is described above is effective, and it is important to remove the excess toner adhering to the surface of an image carrier after transfer.

The toner produced by the above process comprising suspension polymerization, however, is disadvantageous in that it has a particle size (average particle size: 10 to 11 $\mu$m) smaller than that (average particle size: 2 to 9 $\mu$m) of a usually used toner and hence is difficult to remove from the surface of the image carrier after transfer, namely, it is poor in so-called "ease of cleaning". That is, the excess toner remains on the surface of the image carrier even after the fur brush cleaning and is transferred to an undesired area to deteriorate the quality of image.

SUMMARY OF THE INVENTION

The present invention is intended to solve the problems in the above prior art and provide a toner for developing an electrostatic latent image which is good in ease of cleaning, namely, which can easily be removed from the surface of an image carrier after transfer.

For achieving the above object, the following technical means is employed in the present invention: in a toner for developing an electrostatic latent image which comprises at least a binder resin and a colorant, a finely powdered cleaning assistant is added to the surfaces of toner particles with an average particle size of 2 to 9 $\mu$m produced by polymerization, in an amount of 0.1 to 3 parts by weight per 100 parts by weight of the toner particles.

DETAILED DESCRIPTION OF THE INVENTION

In the present invention, when the amount of the finely powdered cleaning assistant added is less than 0.1 part by weight per 100 parts by weight of the toner particles, an improving effect on the ease of cleaning cannot be expected. Therefore, it is not desirable. On the other hand, when the amount exceeds 3 parts by weight, the cleaning assistant is disadvantageously scattered to soil an image and lower the fixability.

As the aforesaid cleaning assistant, oxides of rare earth elements, such as cerium oxide, praseodymium oxide, etc. can be used singly or as a mixture of two or more thereof. As the cleaning assistant, particles having an average particle size of 1 $\mu$m or less, preferably 0.01 to 0.5 $\mu$m, are suitable.

A polymerizable monomer(s) used in the present invention is a radical-polymerizable monomer(s). Such monomers are used singly or in combination of two or more thereof so that the resulting polymer may have characteristics required of the toner. Such monomers includes monovinyl aromatic monomers, acrylic monomers, vinyl ester type monomers, vinyl ether type monomers, diolefin type monomers, monoolefin type monomers, etc.

As components incorporated into the toner particles, there may be incorporated colorants (e.g. carbon black, Aniline Blue, lamp black, Rose Bengale, Quinoline Yellow, Malachite Green, etc.) and various additives used in common dry developers (e.g. charge-controlling agents such as Nigrosine dyes and metal-containing azo dyes; mold releasing agents such as olefin polymers; flowability improvers such as $SiO_2$ and $Al_2O_3$; fillers such as $CaCO_3$; etc.). The total amount of these components is preferably 15% by weight or less for preventing deterioration of the fixability. The colorants are incorporated in a proportion suitable for forming a visible image having a sufficient solid density (usually 1.2 or more). Usually, they are incorporated in an amount of 2 to 20% by weight based on the weight of the toner.

It is also possible to obtain a so-called magnetic toner by incorporating magnetic powder as at least a part of the colorant. As the magnetic powder, there can be used, for example, powders of compounds or alloys which contain a ferromagnetic element such as iron, cobalt, nickel, etc. (e.g. ferrite, magnetite, etc.). For dispersing the aforesaid magnetic powder in the magnetic toner uniformly, it is preferable to form the magnetic powder so as to adjust its average particle size to 0.01 to 3 $\mu$m. The content of the magnetic powder in the magnetic toner is 10 to 80% by weight, preferably 20 to 60% by weight.

In the present invention, there can be used toners with a small particle size which are obtained from the above-mentioned materials by employing various polymerization methods, as described in, for example, Japanese Patent Unexamined Publication Nos. 60-186852 and 60-186854. In detail, there can be used not only granulated polymers obtained by emulsion polymerization, soap-free emulsion polymerization, suspension polymerization, etc. but also particles obtained by dissolving a polymer obtained by any of the above polymerization methods, solution polymerization, bulk polymerization or the like in a solvent, followed by granulation by spray drying. By such a polymerization method, there can be obtained a toner having an average particle size (volume average particle size) of 2 to 9 $\mu$m and a narrow particle size distribution, i.e., a uniform particle size.

In the present invention, materials such as the polymerizable monomer(s), the colorant, the mold releasing agent, a polymerization initiator, a molecular weight modifier, a dispersion stabilizer, etc. are thoroughly mixed, poured into water, and then dispersed by stirring at a high rate with a homogenizer to carry out granulation. After attaining a predetermined particle size distribution, the mixture thus obtained was stirred at a low rate, heated to 40 to 80° C., and subjected to reaction for a predetermined time to complete polymerization. The polymer thus obtained is subjected to steps of water washing, filtering, dehydration and drying to obtain toner particles.

As the polymerization initiator, well-known ones such as potassium persulfate, 2,2'-azobisisobutyro-nitrile, 2,4-dichloroperoxide, redox initiators, etc. can be used singly or in combination of two or more thereof. The amount of the polymerization initiator used is preferably 0.1 to 5% by weight based on the weight of the monomer composition. As the molecular weight modifier, tert-butylmercaptan, tert-dodecylmercaptan, etc. can be used. As the dispersion stabilizer, there can be used gelatin, carboxymethyl cellulose, starch, poly(vinyl alcohol)s, surfactants, etc. The dispersion stabilizer is used preferably in a proportion of 0.01 to 10 parts by weight per 100 parts by weight of the monomer(s).

By employing the constitution described above, the ease of cleaning can be improved and there can be obtained a toner having a uniform and small particle size which is suitable for attaining a high quality of image.

DESCRIPTION OF PREFERRED EMBODIMENT

In the following, parts are all by weight. As raw materials, there were measured 70 parts of styrene, 30 parts of n-butyl methacrylate, 0.5 part of divinylbenzene, 0.5 part of t-laurylmercaptan, 2 parts of azobisisobutyro-nitrile, 9 parts of carbon black (MA-100, mfd. by Mitsubishi Kasei Corp.), 1.0 part of a polyester type dispersant (poly(hexamethylene adipate)) and 2 parts of an electrification-controlling agent (Bontron E-81, mfd. by Orient Kagaku K.K.). They were mixed in a ball mill for 2 hours.

Then, 1,000 parts of ion-exchanged water was placed in a vessel and 0.5 part of γ-anilinomethyltriethoxysilane (SZ6083, mfd. by Toray Silicone Co.) was added thereto and stirred by means of a homogenizer (a homomixer, mfd. by Nippon Tokushu Kika Kogyo K.K.). The monomer composition obtained in the above was added to the resulting dispersion medium and dispersed and granulated at 6,000 r.p.m. for 10 minutes. After replacing the inner atmosphere of the reaction vessel with nitrogen, the homogenizer was replaced with an agitator having paddles. The temperature was raised to 70° C. while continuing stirring at 120 r.p.m., and the reaction was carried out for 10 hours.

The polymer thus obtained was poured into cold water, followed by filtration, alkali cleaning, water washing and then dehydration. The dehydrated product was dried under reduced pressure at 40° C. for 12 hours to obtain toner particles having a volume average particle size of 6 $\mu$m as measured by means of a Coulter counter model TA-II. Then, $CeO_2$ (average particle size: 0.1 $\mu$m) was mixed with 100 parts of the toner particles in each amount shown in Table 1, in a Henshel mixer. As a reference toner, there were used the toner particles which did not contain $CeO_2$.

Each toner prepared in the manner described above was mixed with a ferrite carrier (KBN-100, mfd. by Hitachi Metals Ltd.; particle size 37 to 74 $\mu$m) to obtain a developer having a toner concentration of 3%. Using this developer, an image was reproduced on transfer paper under the conditions described below, and evaluation of the reproduced image, etc. were carried out. The results obtained are also shown in Table 1.

In this case, OPC was used as a photosensitive drum, and the surface potential, the peripheral speed and the bias voltage applied to sleeve were adjusted to −650 V, 60 mm/sec and −550 V, respectively. The rotation rate of a sleeve with an outside diameter of 20 mm made of SUS 304 was adjusted to 160 r.p.m. A permanent magnet member coaxially built in the sleeve was one which had been obtained by 6-pole magnetization. The surface magnetic flux density on the sleeve was adjusted to 750 G. The developing gap between the photosensitive drum and the sleeve was adjusted to 1.0 mm, and the doctor gap between a doctor blade and the sleeve to 0.9 mm. A magnetic brush was formed on the sleeve, from which a toner image was produced on the photosensitive drum. The toner image was transferred to ordinary paper and fixed by the use of a heating roller at 180° C. and at a linear pressure of 1 kg/cm. The surface of the photosensitive drum was cleaned with a fur brush with a diameter of 30 mm at 100 r.p.m.

TABLE 1

| No. | $CeO_2$ (wt %) | Solid density | Fog | Ease of cleaning | Fixability |
|---|---|---|---|---|---|
| 1 | 0 | 1.48 | ○ | X | ○ |
| 2 | 0.5 | 1.45 | ○ | Δ | ○ |
| 3 | 1.0 | 1.45 | ○ | ○ | ○ |
| 4 | 3.0 | 1.46 | ○ | ○ | Δ |
| 5 | 5.0 | 1.43 | ○ | ○ | X |

○: excellent Δ: good X: poor

As is clear from Table 1, in No. 1 in which a conventional toner containing no cleaning assistant $CeO_2$ was used, the ease of cleaning was not satisfactory. On the other hand, in No. 5, the amount of $CeO_2$ used was too large, so that the fixability was low. By contrast, in Nos. 2 to 4, not only the solid density but also the ease of cleaning and the fixability were satisfactory.

Since the present invention has the constitution and action described above, a toner having a uniform and small particle size can be obtained by polymerization, and moreover the ease of cleaning can be improved. Therefore, the present invention is effective in that it permits formation of a highly precise high-quality image.

What is claimed is:

1. A method of forming an image comprising the following sequential steps:

forming an electrostatic latent image on an organic photoconductive drum;

applying a developer containing toner particles to a sleeve in which a permanent magnet member is disposed;

developing the electrostatic latent image by relative rotation of the sleeve to the permanent magnet member such that a magnetic brush is formed on the sleeve, the magnetic brush brushing the surface of the photoconductive drum, whereby a toner image is formed;

transferring the toner image to a transfer means;

fixing the transferred image; and cleaning the remaining toner particles from the image carrier with a fur brush;

wherein said toner particles comprise at least one binder resin and a colorant; from 0.1 to 3 parts by weight, per 100 parts by weight of said toner particles, of finely powdered cleaning assistant is disposed on the surface of said toner particles; said toner particles have an average size of 2 to 9 $\mu$m; said toner particles are produced by polymerization; and said cleaning assistant is at least one oxide of a rare earth element having an average particle size of 0.01 to 0.5 $\mu$m.

2. A method according to claim 1, wherein the oxide of a rare earth element is cerium oxide.

* * * * *